United States Patent [19]

Hardt

[11] Patent Number: 4,659,055

[45] Date of Patent: Apr. 21, 1987

[54] CORNERSTONE MOLD ARRANGEMENT FOR THE OUTER WALLS OF PREFABRICATED BUILDINGS

[76] Inventor: William K. Hardt, Rte. 4, Box 2270, Lake Geneva, Wis. 53147

[21] Appl. No.: 806,407

[22] Filed: Dec. 9, 1985

[51] Int. Cl.[4] ..... E04G 11/00

[52] U.S. Cl. ..... 249/19; 249/16; 249/47; 249/194; 52/259

[58] Field of Search ..... 52/225, 259, 127.3; 249/19, 14, 47, 16, 24, 27, 192, 193, 194

[56] References Cited

U.S. PATENT DOCUMENTS

| | | | |
|---|---|---|---|
| 1,696,700 | 12/1923 | Suiter | 249/27 |
| 2,951,520 | 9/1960 | La Bar | 249/19 |
| 3,653,629 | 4/1972 | Keyston | 249/19 |
| 4,131,406 | 12/1978 | Fresquez | 249/16 X |

*Primary Examiner*—Carl D. Friedman

*Attorney, Agent, or Firm*—Mann, McWilliams, Zummer & Sweeney

[57] ABSTRACT

A building corner arrangement for the outer wall of homes and other buildings that are formed from prefabricated panels made from concrete or other cementitious materials, which panels are of the type in which the panel end walls at each corner of the building outer wall are formed to define an angle that lies in the range of from about 0 to about 90 degrees, relative to the panel outside and inside wall surfaces defined by the panel, that results in the formation of, when two such panels are placed in the usual right angle relation to define a building outer wall corner, a groove or opening that, at the building corner in question, extends the height of such adjacent panels, which corner arrangement involves concrete or other cementitious material filling the indicated groove or opening, and shaped exteriorly of same to define a cornerstone-like configuration that may be similar to that found in the more expensive French Provincial style home, and including a method and mold for making the indicated building corner arrangement.

8 Claims, 9 Drawing Figures

CORNERSTONE MOLD ARRANGEMENT FOR THE OUTER WALLS OF PREFABRICATED BUILDINGS

This invention relates to the formation of low cost buildings, for building homes or the like from prefabricated materials, and more particularly, to the type of inexpensive building in which the building outer walls are defined by prefabricated panels that are individually applied to footings to define the external configuration of the building, with means being provided to secure the adjacent panels to the footing on which they rest and to each other.

The Applicant's allowed patent application Ser. No. 406,573, filed Aug. 9, 1982, entitled Outer Wall Structure For Buildings, is concerned with an outer wall structure for low cost buildings that, for example, are of single story in height having the usual four sides of which each side of the building is made up of a prefabricated or precast, monolithic panel formed from cement or cementitious material. The individual panels have flat and parallel inside and outside wall surfacings, and while the panel end walls are disclosed as being formed at angles other than 45 or 90 degrees, it has been found that such end walls are formed at an angle that preferably lies in the range of from about 0 to about 90 degrees. Four such panels are employed to form the house outer wall structure of said application with the individual panels being crane applied to previously poured footings (laid out in closed perimeter relation) to form the building outer walls, with the footings and panels including means for securing the individual panels to the footing portion on which the individual panels are mounted, and to next adjacent panels. The angular formation of the individual panel end walls results, when the panels are erected with adjacent panels at the usual 90 degree angle relation and in substantial abutting relation at the resulting building outer wall inner corner, in the formation at each such building corner of groove, opening, or slot, that extends the height of the panels defining same and that diverges externally of the building.

The present invention is concerned with a building corner mold arrangement for filling the indicated individual building corner grooves or openings with cementitious material in such a manner that not only does the filling in of the indicated corners contribute to the securing together of the indicated prefabricated panels adjacent the building outer wall corner in question, but also the resulting corner arrangement has a pleasing external appearance that simulates the cornerstone effect of the more expensive French Provincial style buildings.

A principal object of this invention is to provide a building corner arrangement, for home or dwelling building outer walls defined by prefabricated or precast panels of the type disclosed in my said application, which panels form at the external corners of the building outer walls when such panels are erected on their footings, the indicated corner openings or grooves, for not only filling such openings or grooves with concrete or other cementitious material, but also firmly bonding the corner opening filling to the two adjacent panels defining the groove or opening, and shaping the exposed surfacing of the building corner involved to define a cornerstone effect characteristic of the more expensive French Provincial style home.

Another principal object of this invention is to provide a method and mold for forming such building corner arrangement in low cost buildings of the type indicated.

Yet other objects of the invention are to .provide a building corner arrangement that replaces that disclosed in the Applicant's said application, and that are to provide a building corner arrangement of the type indicated, and method and mold for making same, that provides an inexpensive but effective.and long lasting building corner arrangement for prefabricated buildings of the type indicated.

In accordance with the invention, an improved building.. corner is provided for application to the corners of buildings of the type disclosed in the Applicant's said application, wherein the front, rear, and side walls of the building each comprise a prefabricated or precast panel of concrete or other cementitious material, with the respective panels being crane mounted on a previously provided closed perimeter footing for that purpose, and with adjacent of said panels being normally or perpendicularly disposed and in substantial abutting relation at the inside corners of the building inside space defined by the panels as erected. As disclosed in the Applicant's said application, the end walls of the respective prefabricated or precast panels are formed to define, in their erected relations, an opening, groove, or slot therebetween that extends the height of the respective panels at each corner of the building. It is preferred that the indicated angulation of the panel end walls, for purposes of the present invention, lie in the range of from about 0 to about 90 degrees, relative to the inside and outside surfaces of the respective panels, with 90 degrees being preferred. The building corner arrangement in accordance with the present invention involves filling the indicated space, groove, or slot that is defined by the erected panels at the building external corners with cementitious material in such a manner that the cementitious material is shaped externally of the building corner to define a cornerstone-like configuration that in part overlies and adheres to the adjacent ends of the panels, and that in appearance is similar to the cornerstone appearance of the more expensive French Provincial type buildings.

The Applicant's invention is also concerned with a method and mold for effecting the indicated building corner arrangement.

Other objects, uses, and advantages will be obvious or become apparent from a consideration of the application detailed description and the application drawings.

In the drawings:

FIG. 1 is a diagrammatic perspective view illustrating two adjacent wall panels of a building, that are arranged in accordance with the invention of the Applicant's said patent application, to define the outer wall structure of a home, with the footing portions of the closed perimeter footing on which the two illustrated panels rest also being illustrated, as well as the building corner arrangement of the present invention being shown at two of the external corners of the building, including the optional footing improvement involved at the building external corners, with the roof structure, window structure, and door structure of the building being omitted as they have nothing to do with the present invention;

Figure 1:
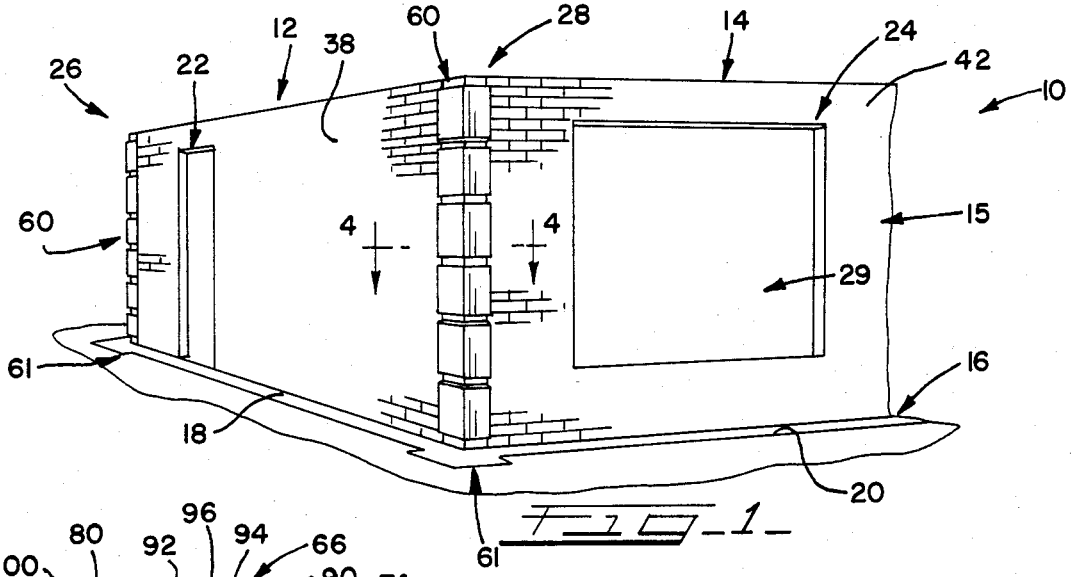
Figure 3:
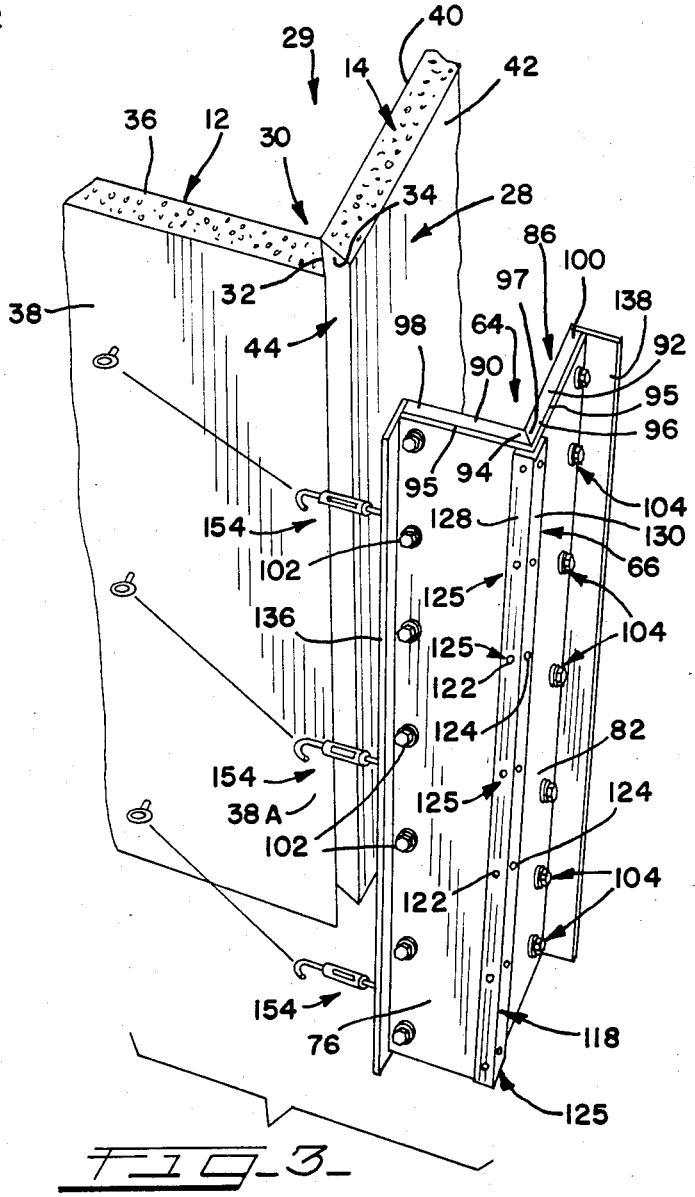
FIG. 3 is a diagrammatic perspective view showing the exterior side of the mold of FIG. 2, and indicating the manner it is to be applied to two adjacent of the prefabricated or precast panels that are disposed to form one corner of the building illustrated in FIG. 1, for instance the building corner at the mid portion of FIG. 1.
Figure 5:
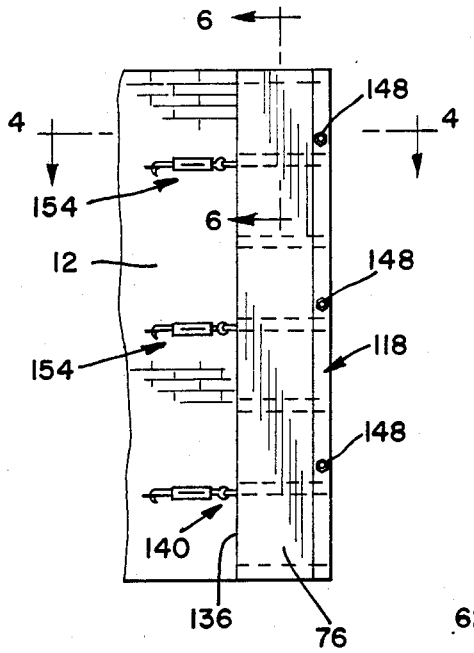
Figure 6:
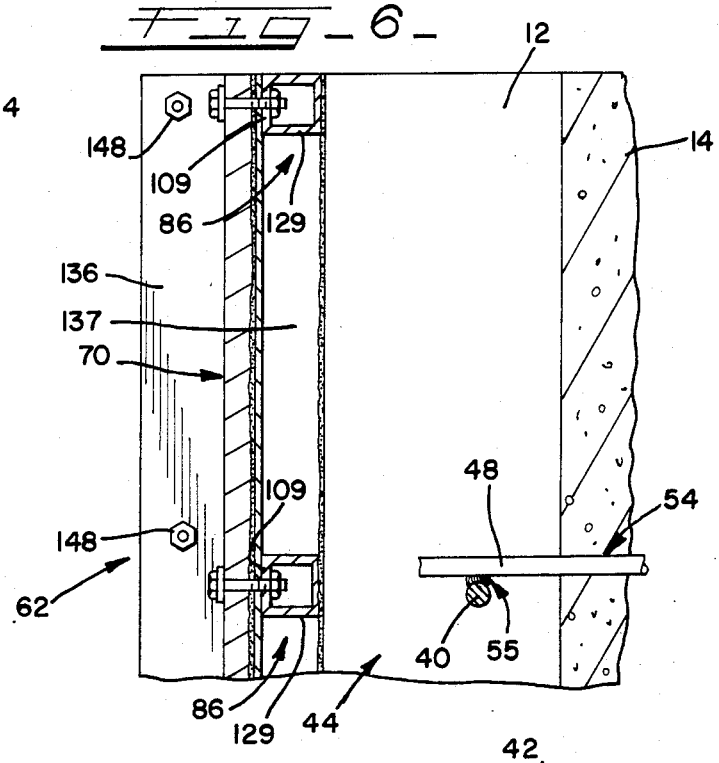
Figure 4:
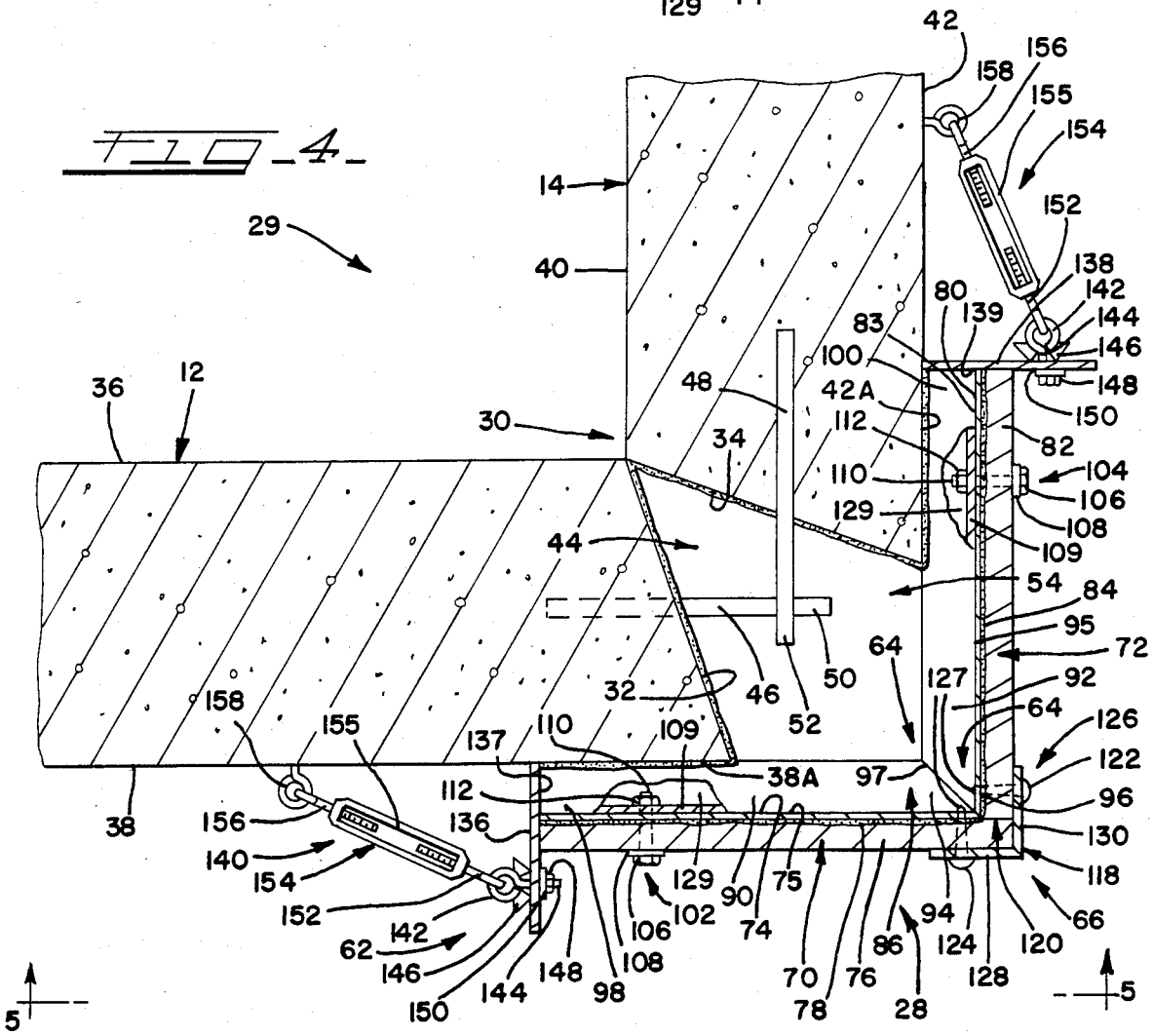
Figure 7:
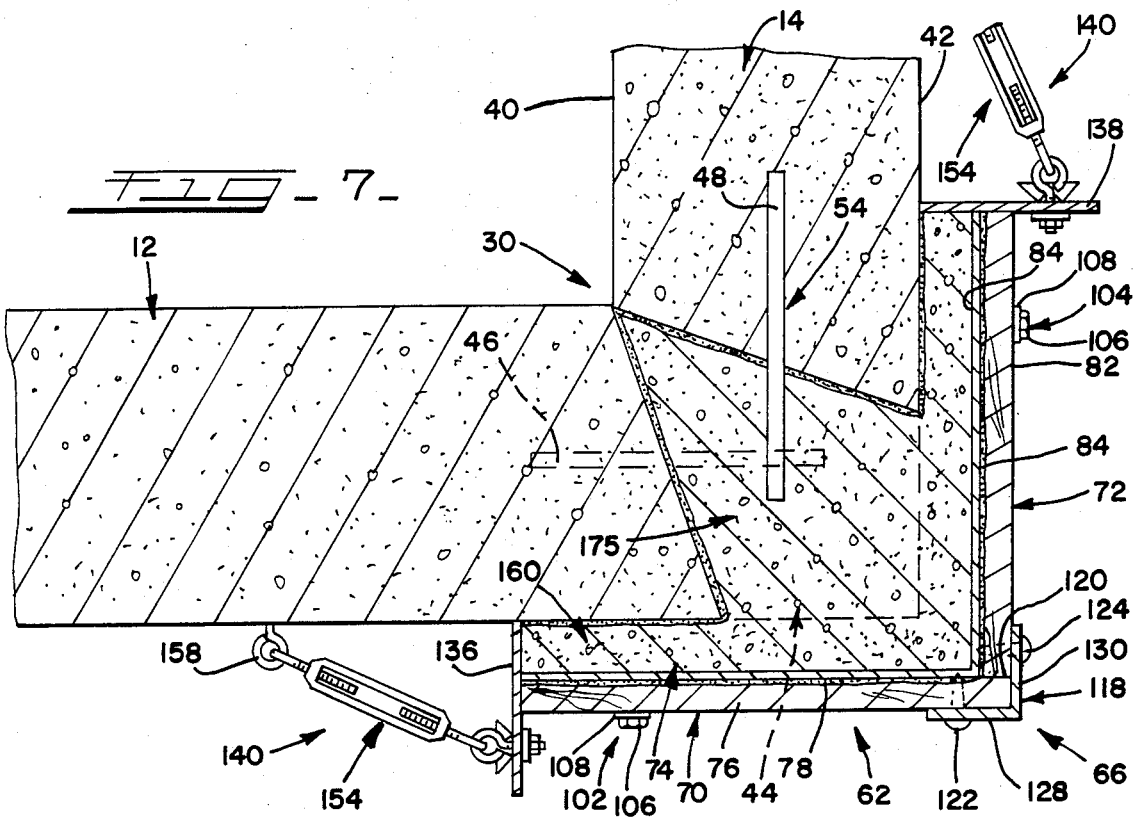
Figure 8:
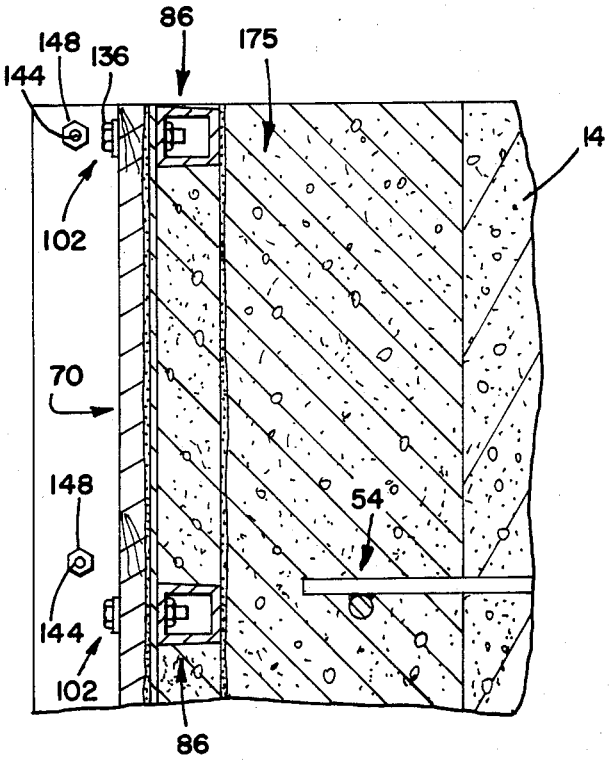
Figure 9:
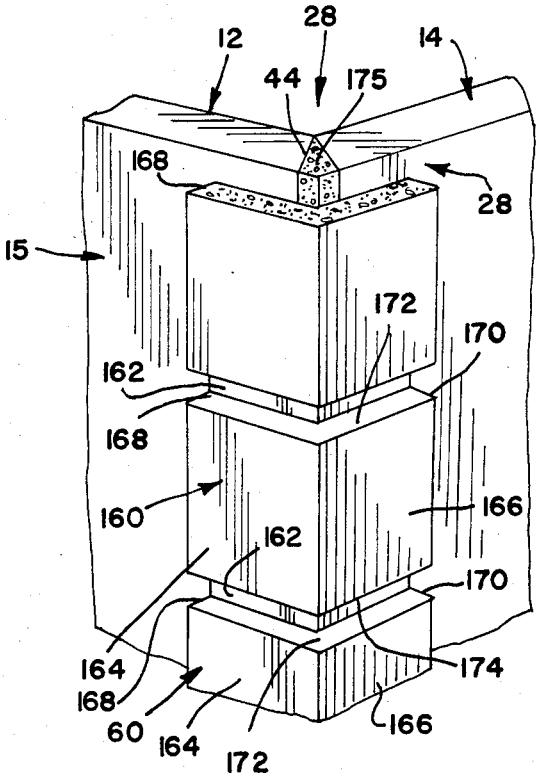

FIG. 4 is a diagrammatic horizontal sectional view taken substantially along lines 4—4 of FIGS. 1 and 5, illustrating more particularly the juxtaposition of the building precast panels of FIGS. 1 and 3, in the manner shown in the Applicant's said application, to form the indicated space, groove, or slot therebetween at the building external corners, also indicating one way of joining such panels together at the building corners, and the manner in which the mold of the present invention is applied across the external corner space or groove and above the footing corner that are involved at the building external corners for purposes of forming the building corner arrangement of the present invention;

FIG. 5 is a side elevational view of the building corner and mold for practicing the present invention, as viewed along line 5—5 of FIG. 4;

FIG. 6 is a fragmental vertical sectional view taken substantially along line 6—6 of FIG. 5;

FIG. 7 is a view similar to that of FIG. 4, but showing the building external corner opening or slot and the adjacent area closed off by the mold of the present invention filled with cementitious material in accordance with the present invention;

FIG. 8 is a view similar to that of FIG. 6, but showing the cementitious material filling the building corner open space or slot in accordance with the present invention; and FIG. 9 is a diagrammatic perspective view on an enlarged scale illustrating the upper portion of the resulting corner arrangement as applied to the upper portion of the prefabricated panels that define the building inside corner shown in FIGS. 1, 3, 4, and 7.

However, it is to be distinctly understood that the specific arrangements shown in the application drawings are provided primarily to comply with the requirements of the Patent Laws, and that the invention is susceptible of modifications and variations that will be obvious to those skilled in the art, and which are intended to be covered by the appended claims.

GENERAL DESCRIPTION

Reference numeral 10 of FIG. 1 generally indicates a newly constructed building arranged in accordance with the disclosure of my said application and my instant application, which building comprises in the form illustrated, monolithic precast or prefabricated panels 12 and 14, formed of concrete or other cementitious material in accordance with the disclosure of said allowed application, reference to which may be had for a description of the basic way in which panels 12 and 14 are formed and erected in place. The building outer wall structure 15, of course, is completed by two other similar panels forming the portions of the building outer walls that are behind the panels 12 and 14, with panel 14 being shown only fragmentally. As disclosed in the said allowed application, in building the building 10, a cementitious footing 16 of generally quadrilateral closed perimeter outline is first laid down in place that defines building wall footing supporting portions along each side of the perimeter of the footing, two of which are shown in FIG. 1 at 18 and 20. The panel 12 is formed to define the building doorway 22 and thus may be considered to form the building front wall, while the panel 14 is formed to define window opening 24, and thus may be considered to define the building right hand side (as viewed from the building front). The building left side and back side are formed by similar panels (not shown) arranged and erected in accordance with my said application (and they may or may not include either a door or a window opening, at the option of the designer). The footing 16 includes the optional improvements described hereinafter.

As disclosed in my said allowed application, the monolithic, precast or prefabricated panels 12 and 14, and other similar panels employed to form the building outer wall structure 15, after the laying down of the footing 16, which is arranged in accordance with the disclosure of said application, are suitably erected on the footing portions, such as portions 18 and 20, using a crane or the like to move them from, for instance, a conveyance therefor, and lower them into place on the footing 16, using the inserts that are anchored in the upper border portion of the panels, in spaced apart relation, for this purpose, as disclosed in said application. When the panels 12 and 14, and the other two panels forming the building 10 are applied to the footing 16, it is assumed that they are connected to the footing portions that supports same using the wall rods and footing anchor rods for this purpose as disclosed in my said allowed application.

In this connection, when it is desired to have a panel 12 or 14 having an outward facing simulating brick work (as illustrated in FIG. 1), stone work or the like, the template of the desired design is employed in the mold in which the panels in question are formed, as disclosed in my said allowed said application. Similarly, color can be introduced in the panels either by tinting the cementitious material or by providing a layer of cementitious material forming one or more of the exposed surfaces of the respective panels, as is also disclosed in my said allowed application.

It is also preferred that the precast panels 12, 14, and the other two outer side wall forming panels of the building 10 be arranged so that those panels that are disposed at the respective building external corners, for instance the corners 26 and 28 of the building 10, be secured one to the other, as disclosed in said application.

In the arrangements disclosed herein, FIGS. 3 and 4 illustrate the building corner 28 that is formed and to be formed in the building 10 in accordance with the practice of the present invention, with the panels 12 and 14 being disposed on their respective footing portions 18 and 20 to define the inside corners 30 of the room space 29 defined by the building outer wall formed by the panels 12 and 14 (or the other panels that are not illustrated), with the panels 12 and 14 being in substantial abutting relation at the inside corner 30 defined by them, as indicated in FIGS. 3 and 4. In accordance with said allowed application, the end walls 32 and 34 of the respective panels forming the outer wall building 10, for instance the panels 12 and 14, are shown at angles that are other than right or 45 degrees relative to the inside surface 36 and the outside surface 38 of panel 12, and with respect to the inside surface 40 and the outside surface 42 of the panel 14. It is now preferred in this connection, that the panel end walls 32 and 34 be angled with respect to their inner and outer surfacings at an angle which lies in the range of from about 0 to about 90 degrees, whereby the adjacent panels of the building 10, for instance the panels 12 and 14, define therebetween, when they are disposed in building external corner forming relation, an opening, groove, or slot 44 as shown in FIGS. 3 and 4. For the practice of the present invention, the 90 degree angulation is preferred, though the less than 90 degree angulation that is illustrated follows the disclosure of my said allowed application.

As indicated in FIGS. 4, 6, 7, and 8, it is also preferable that the panels that form a particular corner of the building 10, for instance the corner 28 that is defined by the panels 12 and 14, be secured to each other, and for this purpose, short rods 46 and 48 are embedded in the respective panels, this being illustrated in connection with panels 12 and 14 as an example. Thus, in the showing of the drawing Figures indicated, the rod length 46 is in coplanar relation with panel 12 and the rod length 48 is in coplanar relation with the panel 14. The rod lengths 46 and 48 may comprise short lengths of the familiar deformed reinforcing rodding that is widely used in concrete construction work for reinforcing purposes, with the rod length 46 defining an end portion 50 that projects into the space or groove 44 and the rod length 48 defining an end portion 52 that also projects into the space or groove 44.

In practice, it is preferred that the rod lengths 46 and 48 be provided in separate sets 54 adjacent the upper and lower portions of the respective panels making up the building outer wall structure 15, for instance 16 inches from the top of the panels 12 and 14 and 16 inches above the bottom of the panels 12 and 14, with the rod lengths 46 of the respective sets 54 being at a different level from the rod length 48 thereof but in close adjacency so that when the panels 12 and 14 are erected, the respective rod lengths 46 and 48 of each set 54 will be disposed adjacent each other and overlap for securing together by employing welding, as at 55 (see FIGS. 6 and 8), or other suitable fastening or bonding means. The remainder of the panels forming the outer wall of the building 10 are secured together at the respective building corners in a similar manner before the corner spaces or grooves 44 are filled in accordance with the present invention.

As has been indicated, the present invention is concerned with the formation at the building corner 28 and other similar corners of the building 10 of the corner arrangement 60 which is diagrammatically illustrated in FIGS. 1 and 9. Further in accordance with the invention the foot 16 at each corners of the building outer wall structure 15, may be optionally enlarged outwardly, as indicated at 61 in FIG. 1, complementarially to the external projection of the building corner arrangements 60, to add to the load support therefor. As disclosed in said allowed application, the panels forming wall structure 15 rest along the centerline of the footing portions involved, with the footing portions projecting exteriorly of the panels in accordance with good building practice. The footing 16 is preferably enlarged exteriorly of the panels a dimension longitudinally of the respective panels that is equivalent to the external projection outwardly of the building corner, for instance, corner 28, plus the dimension needed to support the mold 62 of this invention (in the manner hereinafter made clear) which dimension is approximately two inches. The footing corner enlargements 61 may be omitted where the rod length set 54 at the lower portions of the panels are installed high enough in the panels, for instance, three inches or more.

For the purpose of forming corner arrangement 60, the invention also includes a method of forming the corner arrangement 60, and the mold 62 that is specifically arranged for practice of the method of the present invention.

THE CORNER FORMING MOLD

Figure 2:
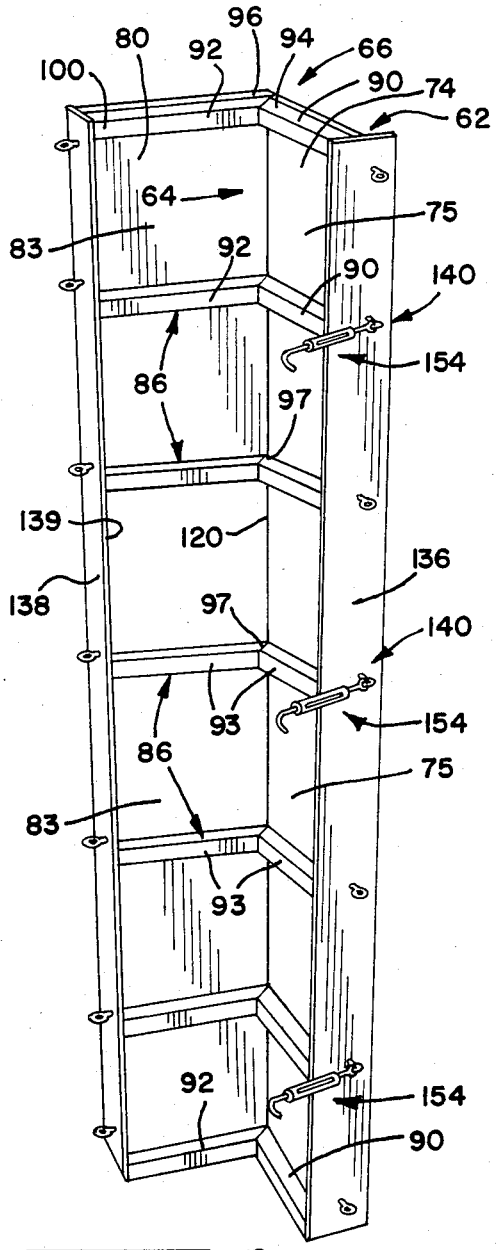
FIG. 2 is a diagrammatic perspective view illustrating a mold for practicing the present invention, showing the inside of same.

Referring to FIGS. 2–4, the mold 62 is shaped to define an inside corner 64 and an outside corner 66 for closing off the space or groove 44 that is defined at the respective building external corners, for instance the corner 28, as well as provide molding space in overlapping relation to the marginal portions 38A and 42A of the panel outer surfaces 38 and 42 that are adjacent the respective panel end walls 32 and 34, with the mold inner side being configured or formed so that the spaces or grooves 44 that are defined by a set of adjacent panels 12 and 14, when filled with cementitious material as contemplated by the present invention, provide, when such cementitious material has set, and the mold 62 is removed, the cornerstone configuration illustrated in FIGS. 1 and 9, which not only resembles that of the familiar French Provincial style of building architecture, but also overlies and adheres to the exterior marginal portions 38A and 42A of the panel outside surfacings 38 and 42 for insuring a secure connection or joint at the respective building corners.

The mold 62 comprises a pair of composite sheets 70 and 72 which are quadrilateral in configuration and which are joined together to define the mold inner corner 64 and outer corner 66.

The composite sheet 70 comprises a sheet 74 formed from aluminum which may have a thickness on the order of 1/16th of an inch, which is bonded to a plywood sheet 76 by a suitable layer 78 of any standard glue or adhesive for bonding metal to wood, such as the contact cement available from Franklin Chemical Industries, of Columbus, Ohio. Composite sheet 72 is similarly arranged, it comprising a similar aluminum sheet 84 bonded to plywood sheet 82 by a layer 84 of the same type of bonding material, with the bonding material indicated by the layers 78 and 84 being coextensive with the respective aluminum sheets 74 and 80.

The mold 62 is also formed internally to define spaced ribs 86 that are nominally right angled in configuration and overlie and extend transversely of the respective aluminum sheets 74 and 80. As indicated in FIG. 2, the ribs 86 are preferably equally spaced apart along the length of the mold 62, and in practice they are spaced apart approximately the height dimension of the individual cornerstones employed in French Provincial style houses at the corners of same; in a preferred embodiment, the ribs 86 are spaced apart approximately seventy inches, but this dimension may be varied for each particular house as desired for aesthetic effect.

In the form shown, each rib 86 comprises a first tubular member 90 and a second tubular member 92, both formed from aluminum to be of approximately square cross-sectional configuration and measuring approximately two inches on a side. For each rib 86, the tubular members 90 and 92 are mitered at their respective ends 94 and 96, which mitered ends are joined together as at 97 by welding or the like, so that the individual ribs define the right angle configuration indicated in FIGS. 2 and 4. The tubular member 90 and 92 each taper in a similar manner, at their upper and lower surfaces, such that ribs 86 are narrowed at their building facing sides 93, as compared to the sides 95 of same that face the respective sheets 70 and 72, by a minimum of 1/16th of an inch, to facilitate mold removal after the concrete forming corner arrangement 60 is cured.

As indicated in FIGS. 4 and 7, the tubular members 90 each defines an end 98 that extends away from the mitered joint 97, while the members 92 each define an end 100 that extends away from the mitered joint 97. For each rib 86, the member 90 is affixed to the composite sheet 70 by suitable bolt and nut assembly 102, while member 92 is secured to the composite sheet 72 by an identical bolt and nut assembly 104.

As indicated in FIG. 4, the respective bolt and nut assemblies 102 and 104 each comprise a bolt 106 seated against a washer 108 on the exterior side of the respective plywood sheets 76 and 82, with the respective bolt shanks 110 passing through aligned holes formed in the respective composite sheets 70 and 72 and the wall 109 of the respective members 90 and 92 that abuts the respective sheets 70 and 72, for application thereto of the respective nuts 112 that are applied to the respective shanks 110 from the ends 98 and 100 of the respective members 90 and 92 when still open, using suitable wrench devices or the like so that the nuts 112 are firmly tightened on bolts 106.

At the external corner 66 defined by the mold 62 reinforcing angle member 118 is applied to fix the composite sheets 70 and 72 together along the joint 120 (see FIGS. 4 and 7). For this purpose, sheet metal screws 122 and 124 are applied in pairs forming sets 125 along the respective planar sections 128 and 130 of the reinforcing member 118, with the sets 125 of screws 122 and 124 being respectively at a level with regard to each rib 86 such that their pointed ends 127 extend through the composite sheets 70 and 72, respectively and support the respective ribs 86 at their respective joints 97, and specifically the lower walls 129 of the respective members 90 and 92, to hold the ribs 86 in substantial parallelism when the mold 62 is in its upright working position indicated in FIGS. 2–8.

In addition, the composite sheet 70 carries the elongate rectangularly configured metal sheet 136, while the composite sheet 72 is equipped with a similar metal sheet 138. The sheet 136 overlies and is affixed to the respective ends 98 of the respective tubular members 90, as by employing welding or the like (after the ribs 86 are mounted in place on the respective assembled composite sheets 70 and 72), while the plate 138 is similarly affixed to the ends 100 of the respective tubular members 92 on that side of the mold 62. In one form of the invention the plates 136 and 138 comprise a one-quarter inch thick aluminum plate that measures six inches in width and extends the height of the mold, with the latter height being determined by the height of the panels 12 and 14 and the similar panels that are involved in the outer wall structure 15 of the building 10.

In a particular embodiment of building 10 to which the invention has been applied, the panels 12 and 14 and the other building defining wall panels, as well as the mold 62, measure eight feet eight inches in height, but, of course, this dimension is optional with the builder, depending on how high the builder wishes to construct the building 10.

As indicated in FIGS. 2–5 and 7, the mold 62 is equipped along the respective side plates 136 and 138 with turnbuckle arrangements 140 in spaced apart relation to hold the mold 62 in the manner it is to be applied in overlapping relation to the vertical spaces or grooves 44 that are defined by placing the building outer wall structure defining panels at right angled juxtaposition, such as is illustrated for the panels 12 and 14 in FIGS. 3 and 4. The turnbuckle arrangements 140 may be of any number on each side plate 136 and 138 of the mold 62 as thought necessary or desirable by the builder; three such arrangements on each side plate 136 and 138 are shown in the illustrated embodiment.

For this purpose, each turnbuckle arrangement 140 comprises an eye member 142 having a threaded shank 144 extending through an appropriate aperture formed in the respective plates 136 or 138 at the locations suggested in FIGS. 2 and 3 and locked between wing nut 146 and standard nut 148 that may be seated against suitable lock washer 150, or welded directly to the respective plates 136 and 138. The eye member 142 receives one threaded shank 152 of suitable turnbuckle device 154 of any suitable standard type, having the usual open centered frame 155 from which extends the second threaded shank 156 of the turnbuckle device 154 that is suitably mounted on eye member 158 that is suitably mounted in the outer surface of the adjacent panel 12 or 14. The eye members 158 may be mounted in operating position in the respective panels 12 and 14 using any conventional manner of applying threaded eye members to slabs of walls formed from cement or a cementitious material. Eye members 158 may be elevationally positioned relative to footing 61 so that on application of the respective turnbuckle devices 154 to same the mold 62 tends to hang from them, with turnbuckles 154 being shortened as needed to properly position mold 62 relative to the external building corner involved for proper functioning as a mold for corner arrangement 60.

In practice, the shanks 152 and 156 of the turnbuckle devices 154 are of suitable open hook relation for ease of application to the respective eye members 142 and 158.

CORNER FORMING METHOD OF INVENTION

Assuming that precast or prefabricated panels equivalent to panels 12 and 14 have been erected and juxtaposed in a manner indicated in FIGS. 3 and 4 to form wall structure 15, while the opening or groove 44 remains open at the exterior of the building 10 at each corner thereof, the rod members 46 and 48 that form the sets 54 of such members adjacent the upper and lower portions of the respective panels are joined together by employing welding or any other suitable manner.

Thereafter, the panel end walls 32 and 34 and the marginal portions 38A and 42A of the panel exterior surfacings 38 and 42, respectively, at each building corner, that are adjacent the space or groove 44 thereof, are coated for the height of the space 44 involved with a suitable concrete or cementitious material binder compound in liquid form of any suitable type that is brushed on the surfaces indicated. Such binders are well known in the art for facilitating the binding of concrete or any other cementitious materials together, an example of which is Larsen's Weld Crete product offered by Larsen Products Corp. of Rockville, Md.

The mold 62 is then disposed against the building exterior wall corner, in this case the corner 28, with the mold 62 resting on the underlying corner defined by footing 16, and the respective side plates 136 and 138 seated against the exterior walls 38 and 42 of the respective panels 12 and 14; the turnbuckle devices 54 are applied between the respective sets of eyes 152 and 158 and operated to firmly bias the mold 62 against the two panels forming the corner being treated, and along the length of the mold 62 and the height of the respective panels in question.

Thereafter, concrete or other cementitious material is introduced into the space or groove 44 at the top of same and poured in until the level of the cement reaches the top of mold 62. The color of the cement or cementitious material employed is optional, though ordinarily the cement or cementitious material employed for this purpose is provided with a suitable sand color or coloring that will give the set concrete or cementitious material an off white cornerstone appearance; while such color is normally off white, beige and light brown can also be provided for, as may be any other color desired.

The concrete or cementitious material applied to the space or groove 44 is then paddled, vibrated, and cured in any conventional manner, it being very important that the concrete or cementitious material be vibrated as needed along the depth of the space 44 to be sure that the concrete or cementitious mixture involved is moved into all the crevises of the molding space created by the mold, and specifically its composite sheets 70 and 72, and its ribbing 86. In this connection, it will be noted that while the building corner space or groove 44 itself is fully filled with the concrete or cementitious material from top to bottom, at the location of the mold 62, the spaced apart ribbings 86 form recesses or indentations in the cement or cementitious mixture involved, while the inwardly facing surfacings 75 and 83 of the respective aluminum plates 74 and 82 define projecting quadrilateral surfacings that are spaced apart by the recesses formed by the ribs 86. In between the ribs 86 the surfacings 137 and 139 of the respective end plates 136 and 138 form planar surfaces in the concrete or cementitious material between the respective ribs 86. As the tubing from which ribs 86 are formed are approximately two inches on a side in the described embodiment, such recesses formed thereby are approximately two inches in depth, and taper inwardly thereof complementing the taper that has been indicated for ribs 86.

After the concrete or other cementitious material has suitably set and cured, the mold 62 is removed, by loosening turnbuckle devices 54 and removing them from application between the mold 62 and the hook eyes 158, and jogging the mold 62 loose using conventional techniques for this purpose; hook eyes 158 may be removed from the respective wall panels involved, and the holes that were made to mount them suitably masked over by employing a suitable concrete or cementitious material patch, as needed.

The result is the formation at the building corner 28 of corner arrangement 60 that is shown in FIGS. 1 and 9, and has the appearance that resembles the cornerstone arrangement customarily employed at the more expensive French Provincial style residence.

As seen in FIG. 9, the corner arrangement 60 comprises a plurality of right angle shaped cement or cementitious material bodies 160 separated by right angle grooves or recesses 162, with the bodies 160 defining planar intersecting side surfaces 164 and 166, planar end surfaces 168 and 170, planar angle shaped top surface 172, and planar angle shaped bottom surface 174. The bodies 160 are adhered to and integral with the body 175 of concrete or other cementitious material occupying the space or groove 44, and also are adhered to the respective panels 12 and 14 on either side of the space or groove 44 exteriorily of, and along the marginal surfacings 38A and 42A of same. The grooves 162 are formed by the respective ribs 86, with the indented portion of the respective grooves 162 comprising the portion of the coating formed by the brushed on binder material that is shown in section in FIGS. 4 and 5. At the top and bottom of the corner arrangement 60 that is illustrated, the adjacent bodies 160 are spaced from the top of the corner of the building 10 and its footing at such corner (for instance, corner 28) by the dimension of the mold top and bottom ribs 86 (note FIGS. 2 and 3).

It will thus be seen that the invention provides a corner arrangement for inexpensive buildings, and particularly of the type formed pursuant to the disclosure of my said patent application. The corner arrangement involved in the practice of the invention is formed by the practice of the method and use of the mold herein disclosed.

The cornerstone effect provided by the building corner arrangement of this invention normally does not require paint or touch up to complete, but, of course, the areas involved may be painted if so desired to the color preferred by the house owner.

The vibrators used in the practice of the invention may be any suitable form of electric vibrator that is proportioned for lowering to the bottom portion of the space or groove 44 and gradual raising through the length of same to the top of same. Additional cement or cementitious material may be applied at the top of the opening or groove 44 as needed to effect the final product shaping shown at FIG. 9.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. For a building exterior wall structure in which at a corner of the building the wall structure includes a pair of adjacent precast paels, each having an inside wall surfacing and an exterior wall surfacing, that are disposed in substantial abutting relation at the inside corner of the wall structure and define a groove therebetween extending substantially continuously for the height of the adjacent panels, a mold for closing the groove with a cementitious material filling that also overlies the margins of each of the panel exterior surfacings that border the groove a predetermined distance, said mold comprising:

a pair of elongate sheets of cementitious material barrier material secured together to define along adjacent longitudinally extending edges of said sheets an internal corner having a length approximately the height dimension of the groove, said sheets comprising planar mold surfaces that are substantially normal with respect to each other, said mold having equally spaced therealong right angle transversely extending ribs that are on the internal corner side of said mold, and that are of like external configuration, said ribs each having first like end portions terminating at the other longitudinally extending edge of one of said sheets, in flush relation thereto, said ribs each having second like end portions terminating at the other longitudinally extending edge of said sheets in flush relation thereto, and including a first flange secured to said one sheet along said other longitudinally extending edge thereof and in normal relation thereto and having one marginal edging of same in substantial congruent relation with said first rib end portions, and a second flange secured to said other sheet along said other longitudinally extending edge thereof and in normal relation thereto and having one marginal edging of same in substantially congruent relation with said second rib end portions, and means for releasably setting said mold in overlying relation to the groove with said ribs and said flange marginal edges seating against the exterior wall surfacings of the respective precast panels on either side of the groove free of bracking of said mold against the inside wall surfacings of the precast panels, whereby, said mold and the groove define a molding space for receiving the cementitious material, and said planar mold surfaces and said ribs configure such cementitious material at the internal corner side of the mold to define vertically separated bodies of quadrilateral configuration that overly the margins of the respective panel exterior surfacings and that present a cornerstone appearance.

2. The mold set forth in claim 1 wherein:

said setting means comprise turnbuckle means disposed in spaced relation along the respective flanges.

3. The mold set forth in claim 2 wherein:

said turnbuckle means disposed along said first flange include mounting means therefor anchored to said first flange, and said turnbuckle means disposed along said second flange including mounting means therefor anchored to said second flange.

4. The mold set forth in claim 3 wherein:

said flanges each have a second marginal edging projecting oppositely of said one marginal edging thereof, said marginal edgings of each said flange being in coplanar relation therewith.

5. The mold set forth in claim 1 wherein:

said sheets each comprise an aluminum plate defining said planar surface thereof that is bonded in congruent relation to a planar plywood member.

6. The mold set forth in claim 5 including:

a reinforcing angle member affixed across and along the length of the external corner defined by said plywood members.

7. The mold set forth in claim 6 wherein:

said ribs each comprise a pair of tubular members formed from a metal and bonded together at like ends at the internal corner defined by said sheets, with each pair of tubular members having their other ends bolted to the respective elongate sheets, said like ends of said ribs being located by screw means.

8. The mold set forth in claim 7 wherein:

said screw means secure said reinforcing angle member to said sheets.

* * * * *